US008943875B2

(12) United States Patent
Reimann et al.

(10) Patent No.: US 8,943,875 B2
(45) Date of Patent: Feb. 3, 2015

(54) MOPPING DEVICE

(75) Inventors: Ulla Reimann, Salo (FI); Keijo Lindholm, Salo (FI); Aulis Tuominen, Salo (FI); Sakari Laehdetie, Turku (FI); Eija Pesonen-Leinonen, Helsinki (FI)

(73) Assignee: Carl Freudenberg KG, Weinheim (DE)

( * ) Notice: Subject to any disclaimer, the term of this patent is extended or adjusted under 35 U.S.C. 154(b) by 202 days.

(21) Appl. No.: 13/379,560

(22) PCT Filed: Jun. 23, 2010

(86) PCT No.: PCT/EP2010/003766

§ 371 (c)(1),
(2), (4) Date: Dec. 20, 2011

(87) PCT Pub. No.: WO2010/149349

PCT Pub. Date: Dec. 29, 2010

(65) Prior Publication Data

US 2012/0103078 A1 May 3, 2012

(30) Foreign Application Priority Data

Jun. 25, 2009 (DE) ..... 10 2009 030 658

(51) Int. Cl.

| | |
|---|---|
| ***G01N 5/02*** | (2006.01) |
| ***A47L 13/254*** | (2006.01) |
| ***A47L 13/42*** | (2006.01) |

(52) U.S. Cl.

CPC ..... *A47L 13/254* (2013.01); *A47L 13/42* (2013.01)

USPC ..... 73/73; 15/119.2; 324/71.1

(58) Field of Classification Search

CPC ..... G01N 5/02

USPC ..... 73/73–77; 15/114–121; 324/71.1

See application file for complete search history.

(56) References Cited

U.S. PATENT DOCUMENTS

| | | | | |
|---|---|---|---|---|
| 5,424,939 | A | 6/1995 | Kweon | |
| 6,433,244 | B1 * | 8/2002 | Roe et al. | 604/361 |
| 6,981,405 | B2 * | 1/2006 | Wimmer | 73/74 |
| 8,366,630 | B2 * | 2/2013 | Haick et al. | 600/532 |
| 2007/0192979 | A1 | 8/2007 | Knopow et al. | |
| 2011/0167894 | A1 * | 7/2011 | Samuilov | 73/25.05 |
| 2013/0061660 | A1 * | 3/2013 | Kasama et al. | 73/31.06 |

FOREIGN PATENT DOCUMENTS

| | | | |
|---|---|---|---|
| DE | 4244433 | A1 * | 6/1994 |
| DE | 4244433 | A1 | 6/1994 |
| DE | 4411185 | A1 | 11/1994 |
| JP | 2003 299609 | A | 10/2003 |
| JP | 2003299609 | * | 10/2003 |

* cited by examiner

*Primary Examiner* — Hezron E Williams
*Assistant Examiner* — Hoang Nguyen
(74) *Attorney, Agent, or Firm* — Leydig, Voit & Mayer, Ltd.

(57) ABSTRACT

The invention relates to a mopping device (1) having a mop plate (2), or which a mop cover (3) can be fastened in a replaceable manner, wherein a measuring device (4) for detecting the residual moisture present in the mop cover (3) is integrated in the mop plate (2).

10 Claims, 3 Drawing Sheets

MOPPING DEVICE

CROSS-REFERENCED TO RELATED APPLICATION

This patent is the national phase of PCT/EP2010/003766, filed Jun. 23, 2010, which claims the benefit of German Application No. 10 2009 030 658.7, filed Jun. 25, 2009.

FIELD OF THE INVENTION

The invention concerns a mopping device with a mop plate on which a mop cover can be affixed in a replaceable manner.

BACKGROUND OF THE INVENTION

Mopping devices with mop plates on which mop covers can be affixed in a replaceable manner are generally known. Such mopping devices are used for wet floor cleaning in household and commercial establishments. For the cleaning of floors in public buildings, reliable handling is needed in addition to cleaning efficiency. To achieve a high and efficient cleaning performance, one must take care that the mop cover always has a sufficiently high dirt absorption capacity. From DE 42 44 433 C2, a mopping device with a mop plate is known, wherein a measuring device is integrated into the mop plate. This measuring device records the pH value of the cleaning solution in the mop cover clamped on the mop plate. It has been shown, however, that the pH value is greatly dependent on the cleaning agent used and therefore a conclusion as to dirt content is not readily possible.

BRIEF SUMMARY OF THE INVENTION

An object of the invention is to provide a mopping device with a measuring device, which operates straightforwardly to indicate the remaining cleaning performance of the mop cover being used at the moment.

To this end, a measuring device for detecting the residual moisture present in the mop cover is integrated into the mop plate. Within the course of comprehensive investigations, it became evident that the remaining cleaning performance and the loading of the mop cover with dirt are directly connected with the residual moisture of the mop cover. This is particularly true with regard to stubborn and adhering dirt. With a small amount of cleaning liquid, a mop cover also has a certain binding capacity for dust and other loose soilings. However, it has been shown that a sufficient dissolution capacity, with respect to adhering dirt, results only in a sufficient—that is, a higher—load of cleaning liquid in the mop cover. This means that the cleaning performance declines if there is only a small quantity of cleaning liquid remaining in the mop cover. The less cleaning liquid found in the mop cover, the less dirt which can be bound in the mop cover. In actual practice, a visual inspection of the residual moisture still remaining in the mop cover is often carried out, wherein a criterion for the change of the cover is often the so-called tearing of the moisture film on the floor. This criterion, however, which is dependent on the type of floor and the light conditions, is an insufficient evaluation. The measuring device, integrated into the mop plate, detects the moisture formed by the cleaning liquid in the mop cover. It is particularly advantageous hereby that it is not absolutely necessary to modify the mop cover, since the residual moisture can be directly detected by the measuring device. Therefore, any already obtainable mop cover can continue to be used. The measuring device requires energy to a small extent, an energy can be provided by a battery integrated into the measuring device or by a storage battery. When using traditional mop covers, it may be necessary to calibrate the measuring device first. Preferably, the measuring device comprises a device for the averaging of measurement values recorded over a prespecified time period, so that a short interruption of the contact between the mop cover and the mop plate does not lead to a triggering of a signal.

The measuring device can be operatively connected with a signaling device. The signaling device can emit acoustic and/or optical and/or tactile signals, if the measuring device detects a prespecified threshold value of the residual moisture bound in the mop cover. For easy recognition, the signaling device is preferably placed on the upper side of the mop plate—that is, the side turned away from the mop cover. The signaling device can also be placed on the handle or be triggered by remote transmission.

The measuring device can have two contact surfaces at a distance from one another, which can be brought into contact with the mop cover. The contact surfaces are placed on the underside of the mop plate—that is, the side facing the mop cover—and are in contact with the mop cover.

The measuring device can determine an electrical parameter of the mop cover. Such measurement variables can be determined in a particularly simple manner, and a large number of measurement methods are known for determining electrical parameters. Moreover, the materials of the mop cover—mostly plastics—basically have electrical parameters different from the cleaning liquid, mostly water with a cleaning agent and dirt particles, and therefore are good indicators for determining the residual moisture of the mop cover.

The measuring device can determine the electrical resistance of the mop cover. The electrical resistance of the mop cover is directly dependent on its loading with cleaning liquid. According to one known measurement method, the contact surfaces impinge on the mop cover with less than 50 Hz, using a direct voltage or a low-frequency alternating voltage, wherein the electrical resistance of the mop cover behaves in a manner proportional to the measured electrical current. In another patent method, the electrical conductance of the mop cover can also be determined. The electrical conductance is the reciprocal of the electrical resistance. It can be determined by the impingement of the mop cover with a higher-frequency electrical alternating voltage of more than 50 Hz. Both measurement methods are relatively simple.

The measurement device can also determine the permittivity of the mop cover. The permittivity, the capacity value, is a measurement of the permeability of a material for electrical fields. For example, polypropylene, a material frequently used for mop covers, has a permittivity of approximately 2 and water has a permittivity of 80. A high loading of the mop cover with water accordingly results in a higher permittivity than an unloaded mop cover. Other contact surfaces can be integrated in the mop cover. The other contact surfaces are preferably operatively connected, in an electrically conductive manner, with the contact surfaces of the mop plate and thus improve the measurement result and the measurement accuracy.

The mop cover can be provided with metal wires or electrically conductive threads. They are preferably arranged parallel to one another. The metal wires or the threads also improve the measurement result, since they are at a defined distance from one another and thus provide measurement results, comparable to one another. To this end, the metal wires are preferably connected with the other contact surfaces. It is also conceivable that the metal wires are in direct contact with the contact surfaces of the mop plate or that the metal wires or the threads have extended areas, which form additional contact surfaces. Metal wires or threads are particularly low-cost and simple to process. However, the binding in of conductive structures instead of metal wires is also conceivable. Such structures can, for example, be electrically conductive carbon-containing threads.

The measuring device can comprise nanotubes for detecting water vapor. Nanotubes can detect volatile gases depending on the equipment, wherein, in accordance with the invention, water vapor can be used as the indicator of the loading of the mop cover with cleaning liquid.

A method is also provided for monitoring the cleaning performance of a mop cover affixed to a mop plate of a mopping device in which the quantity of cleaning liquid present in the mop cover is detected by a measuring device integrated into the mop plate. A signal is triggered if a prespecified threshold value of the quantity of cleaning liquid is not reached or is exceeded. An indication that a threshold has been exceeded prevents the overloading of the mop cover with cleaning liquid during the rinsing and the subsequent wringing or during the preliminary moistening or impregnating of the mop cover.

BRIEF DESCRIPTION OF THE DRAWINGS

Some examples of the mopping device, in accordance with the invention, are explained, below, with the aid of the figures.

DETAILED DESCRIPTION OF THE INVENTION

Figure 1:
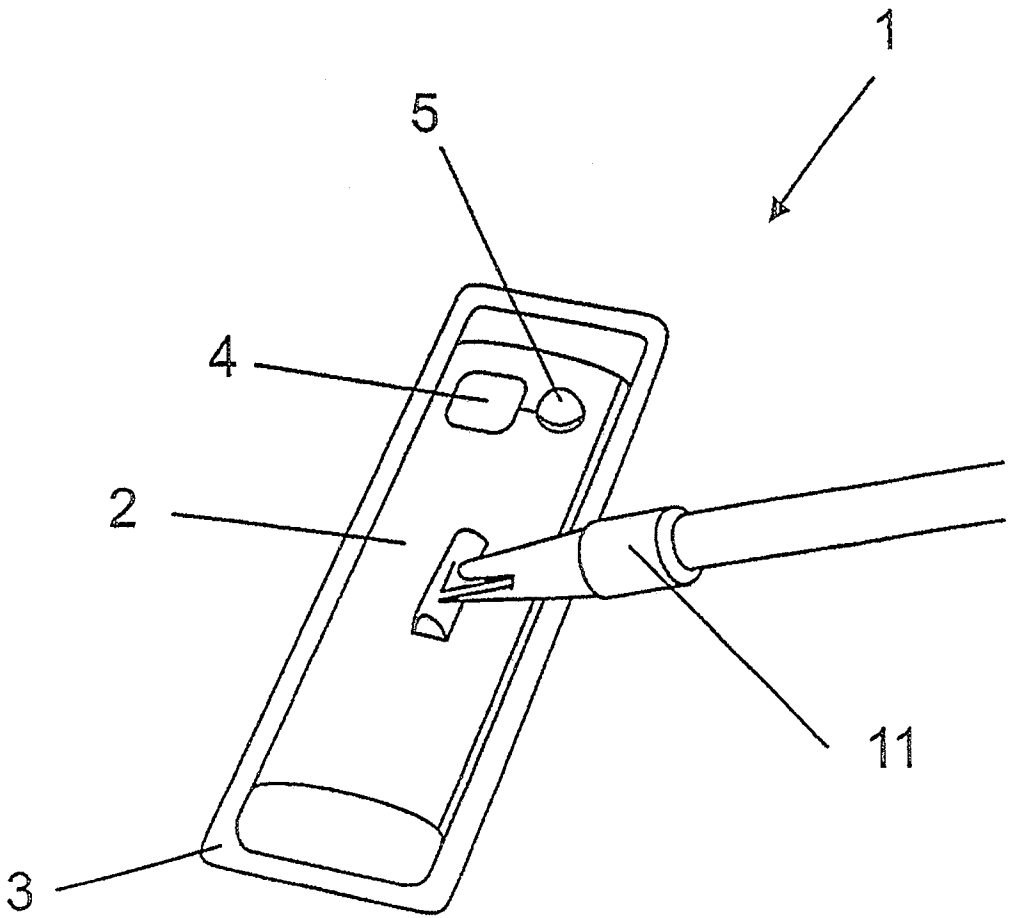
FIG. 1 is a schematic partial top perspective view of an exemplary mopping device with clamped-on mop cover.

FIG. 1 illustrates a mopping device 1—in this case, a flat mopping device—with a mop plate 2 on which a handle 11 is affixed in an articulated manner. A mop cover 3 can be affixed on the cover plate 2 so it can be replaced. A measuring device 4 to detect the residual moisture present in the mop cover 3 is integrated into the mop plate 2, and the measuring device 4 is operatively connected with a signaling device 5. The measuring device 4 is firmly bound into the mop plate 2 and the optical and acoustic signaling device 5 is affixed on the upper side of the mop plate 2, on the side turned away from the mop cover 3. The measuring device 4 has two contact surfaces 6, 7 arranged at a distance from one another on the underside of the mop plate 2 (i.e., the side facing the mop cover 3). The contact surfaces 6, 7 can be brought into contact with the mop cover 33. In the illustrated embodiment, the measuring device 4 is designed in such a way that it determines the electrical resistance of the mop cover 3. To this end, the contact surfaces 6, 7 are impinged with an electric voltage and the electric current is determined by the measuring device. The resulting electric resistance correlates directly with the residual moisture present in the mop cover 3 and it, in turn, correlates directly with the loading of the mop cover 3 with dirt. After exceeding a prespecified threshold electric resistance—that is, after falling short of a prespecified threshold value for the amount of cleaning liquid in the mop cover, the signaling device 5 is triggered by the measuring device 4. In this way, a user is signaled either to rinse or to replace the mop cover 3. To improve the electrically conductive contact, additional contact surfaces 8, 9 can be integrated into the mop cover 3, which are operatively connected with the contact surfaces 6, 7 of the mop plate 2. To improve and provide greater uniformity in the measurement result, metal wires 8, 9, can be arranged parallel to one another in the mop cover 3 which are brought into contact during cleaning with the contact surfaces 6, 7 of the mop plate 2. In another embodiment, a measurement of the conductance of the mop cover 3 takes place. In such a case, the mop cover 3 is impinged on by an alternating voltage and the conductance of the mop cover 3 is determined as a function of the measured electrical current, which, in turn, is directly correlated with the residual moisture. According to another embodiment, the permittivity—that is, the capacity value of the mop cover 3—can be determined. The permittivity of the material of the mop cover 3, frequently a material based on polypropylene, greatly deviates from the permittivity of water, so that the content of residual moisture can be determined from the value of the permittivity. The residual moisture correlates directly with the remaining cleaning performance of the mop cover 3 or the loading of the mop cover 3 with dirt. All three methods have in common that by means of an electric characteristic value of the mop cover, the loading of the mop cover 3 with cleaning liquid can be detected. The individually required measuring devices 4 do not differ substantially from one another; in all cases, the mop cover 3 is impinged on with an electrical voltage and additional electrical parameters, resulting from the impingement with the voltage, are determined.

Figure 2:
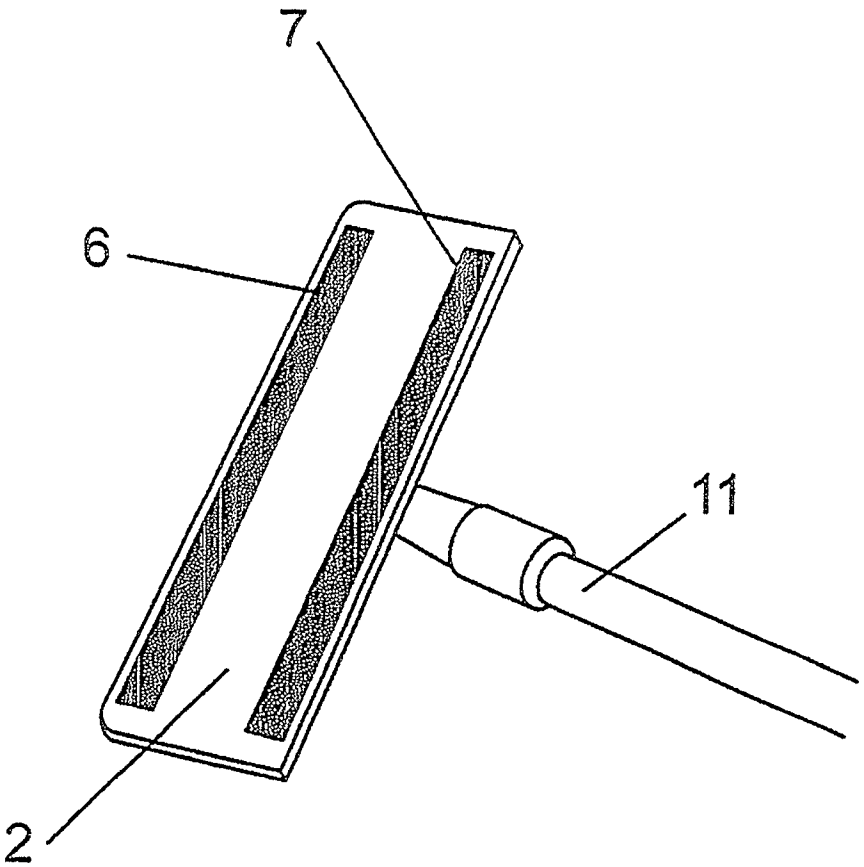
FIG. 2 is a schematic partial bottom perspective view of the mopping device of FIG. 1.

FIG. 2 provides a lower view the mopping device 1 of with FIG. 1, in the lower view.

Figure 3:
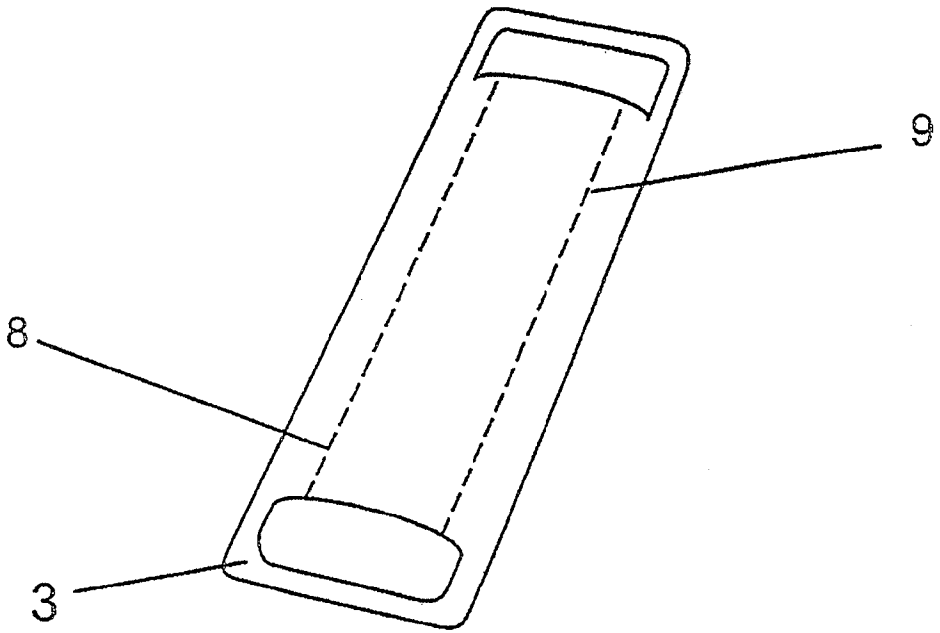
FIG. 3 is a schematic perspective view of an exemplary a mop cover with integrated, conductive structures.

FIG. 3 shows a mop cover 3 for use on a mopping device 1 according to FIG. 1. The mop cover 3 is made of polypropylene and on the side facing the mop plate, has several longishly formed, electrically conductive structures, arranged parallel to one another—in this case, metal wires 8, 9. They can be brought into contact, in an electrically conductive manner, with the contact surfaces 6, 7 of the previously described mop plate 2.

The invention claimed is:

1. A mopping device comprising: a mop plate on which a mop cover can be affixed in a replaceable manner and a measuring device for the detection of the residual moisture present in the mop cover, the measuring device being integrated into the mop plate, wherein the measuring device has two contact surfaces arranged at a distance from one another and arranged such that the contact surfaces can be brought into contact with the mop cover.

2. A mopping device according to claim 1, wherein the measuring device is operatively connected with a signaling device.

3. A mopping device according to claim 1, wherein the measuring device determines an electrical parameter of the mop cover.

4. A mopping device according to claim 1, wherein the measuring device determines the electrical resistance or the conductance of the mop cover.

5. A mopping device according to claim 1, wherein the measuring device determines the permittivity of the mop cover.

6. A mopping device according to claim 1, wherein additional contact surfaces are integrated into the mop cover.

7. A mopping device according to claim 1, wherein the mop cover is provided with electrically conductive wires or threads.

8. A mopping device according to claim 1, wherein the measuring device comprises nanotubes to detect water vapor.

9. A method for monitoring the cleaning performance of a mop cover affixed on a mop plate of a mopping device comprising the steps of: detecting the quantity of cleaning liquid presented in the mop cover with a measuring device integrated into the mop plate, and triggering a signal when the detected quantity of cleaning liquid is below a prespecified threshold.

10. The mopping device according to claim 2, wherein the signaling device is configured to provide a signal when the residual moisture detected by the measuring device is below a threshold value.

* * * * *